US006371320B2

(12) United States Patent
Sagol

(10) Patent No.: US 6,371,320 B2
(45) Date of Patent: Apr. 16, 2002

(54) PORTABLE WORKSHOP CONTAINER ASSEMBLY

(75) Inventor: Sami Sagol, Ramat Hasharon (IL)

(73) Assignee: Keter Plastic Ltd., Herzlia (IL)

( * ) Notice: Subject to any disclaimer, the term of this patent is extended or adjusted under 35 U.S.C. 154(b) by 0 days.

(21) Appl. No.: 09/785,658

(22) Filed: Feb. 20, 2001

(30) Foreign Application Priority Data

Mar. 12, 2000 (IL) ..... 135019

(51) Int. Cl.[7] ..... B65F 21/032

(52) U.S. Cl. ..... 220/4.27; 220/23.83; 220/326; 206/501

(58) Field of Search ..... 220/23.83, 23.86, 220/23.87, 326, 4.27, 503, 505, 691; 206/501, 373, 372; 280/47.26

(56) References Cited

U.S. PATENT DOCUMENTS 4,619,363 A * 10/1986 Wolfseder ..... 206/373
5,011,013 A * 4/1991 Meisner et al. ..... 206/373
5,518,139 A 5/1996 Trower et al.
5,799,787 A * 9/1998 Talbot ..... 220/23.83
5,833,065 A * 11/1998 Burgess ..... 220/23.83
6,176,559 B1 * 1/2001 Tiramani et al.
D437,484 S * 2/2001 Tiramani et al.
6,193,062 B1 * 2/2001 Rysgaard et al. ..... 206/373

FOREIGN PATENT DOCUMENTS

EP 0 933 170 A2 8/1999
GB 2298190 * 8/1996

* cited by examiner

*Primary Examiner*—Stephen Castellano
(74) *Attorney, Agent, or Firm*—Browdy and Neimark

(57) ABSTRACT

A portable workshop container assembly adapted to store tools and other articles a worker requires to perform various tasks at a workplace. The assembly includes three major components in stacked relation. The lower component is a wheeled bucket, the middle component is a tray nested in the bucket and provided with a rim, and the third component is a tool box that rests on the rim. Also provided is a latching mechanism having a latch which is pivoted by a toggle member to the upper end of the bucket and cooperates with a first catch element mounted at the bottom of the tool box and a second catch element mounted on the rim of the tray. When the tool box rests on the rim, the first and second catch elements are then adjacent each other. In one mode of operation, the latch simultaneously engages the first and second latch elements to interlock all three components to form a unitary assembly that can be wheeled to the work place.

9 Claims, 9 Drawing Sheets

PORTABLE WORKSHOP CONTAINER ASSEMBLY

FIELD OF THE INVENTION

This invention relates generally to containers adapted to store tools, nuts and bolts, and whatever other articles a worker requires to perform various tasks at a workplace, and more particularly to a portable workshop container assembly which can be wheeled to a workplace.

BACKGROUND OF THE INVENTION

Status of Prior Art

When a mechanic works in a garage to repair automobiles, the tools, the gauges, the bolts and all other articles he may require for this purpose are then available to the mechanic in a workshop.

But when a worker is required to go to a work place which is not a workshop in that it lacks the tools and other articles needed by the worker to perform various tasks, then the worker must bring along to the work place whatever tools and articles he needs to do the job he is expected to carry out, thereby converting the unequipped work place into a workshop.

In those cases where the tools and other articles the worker requires for the job at the work place can be stored in a tool box, then the worker can hand carry the tool box to the work place and then, in effect, transform it to a workshop. But more often than not, what the worker needs to bring to the work place cannot be fully accommodated even in an exceptionally large-capacity tool box.

To make it possible to wheel to a workplace a container capable of storing not only tools but whatever other articles are necessary to carry out the job to be performed at the work place, it is known to provide for this purpose a portable, wheeled container. One such "Rolling Container Assembly" is disclosed in the European Patent Application EPO 933 170 A2 (1999) to Tirami et al. This assembly is formed by a wheeled cabinet, on which is placed a set of drawers, on top of which is a tool case. The set of drawers is joined to the wheeled cabinet by a snapping mechanism, a separate snapping mechanism being provided to join the set of drawers to the tool case.

One practical drawback to this EPO assembly is that it entails the use of separate snapping mechanisms. Thus to remove the tool case, one must operate one mechanism, whereas to separate the set of drawers from the cabinet, it is then necessary to manipulate the other snapping mechanism.

Another drawback of the EPO container assembly is that it is only provided with a set of front wheels. Hence the only way this assembly can be rolled to the work place is to first tilt the assembly so that it can be made to run on its front wheels. But should the assembly be heavily loaded, it may be dangerous to tilt the assembly, for in doing so, the assembly may topple over.

When a wheeled container assembly is heavily loaded, it is best to maintain it in an erect state and to push it forward, for that is the only safe way to move the assembly. But this is not possible with the EPO assembly having a set of front wheels and a rear which normally rests on the ground.

SUMMARY OF THE INVENTION

In view of the foregoing, the main object of the invention is to provide an improved portable workshop container assembly capable of storing a heavy load of tools and other articles, and of being rolled to a work place to transform it to an equipped workshop.

A significant advantage of an assembly in accordance with the invention is that it accommodates tools in one compartment and stores other articles in other compartments, which compartments can each be separated from the assembly and given different positions in the work place.

More particularly, an object of the invention is to provide a portable workshop container assembly having three major components in stacked relation which are interlocked by a common latching mechanism to form a unitary assembly that can be rolled to a work place.

A salient feature of a latching mechanism in accordance with the invention is that it makes it possible in one mode to intercouple all three components of the assembly while in other modes one can withdraw from the assembly any one of its components.

Yet another object of the invention is to provide a rolling container assembly that can either be pushed or pulled to a work place. When the assembly had a relatively light load, it can be tilted and pulled, whereas when it is heavily loaded, it can be maintained in an erect state and safely pushed.

Briefly stated, these objects are attained in a portable workshop container assembly adapted to store the tools and other articles a worker requires to perform various tasks at a workplace. The assembly includes three major components in stacked relation. The lower component is a wheeled bucket, the middle component is a tray nested in the bucket and provided with a rim, and the third component is a tool box that rests on the rim.

Also provided is a latching mechanism having a latch pivoted by a toggle member to the upper end of the bucket and cooperating with a first catch element mounted at the bottom of the tool box and a second catch element mounted on the rim of the tray. When the tool box rests on the rim, the first and second catch elements are then adjacent each other. In one mode of operation, the latch simultaneously engages the first and second latch elements to interlock all these components to form a unitary assembly that can be wheeled to the work place.

BRIEF DESCRIPTION OF THE DRAWINGS

For a better understanding of the invention as well as other objects and further features thereof, reference is made to the attached drawings, in which.

DETAILED DESCRIPTION OF A INVENTION

Figure 1:
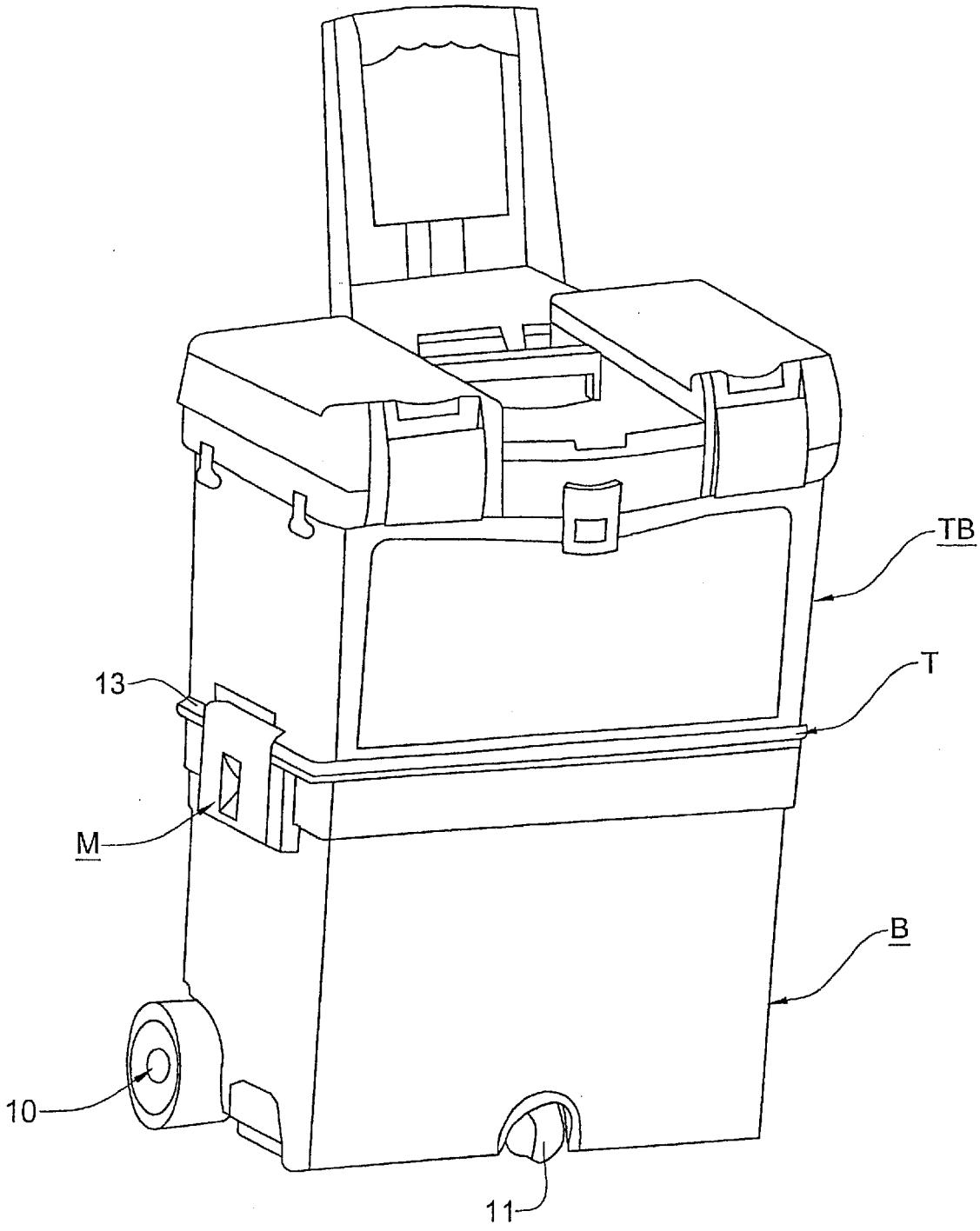
FIG. 1 is a perspective view of a portable workshop container assembly in accordance with the invention.
Figure 2:
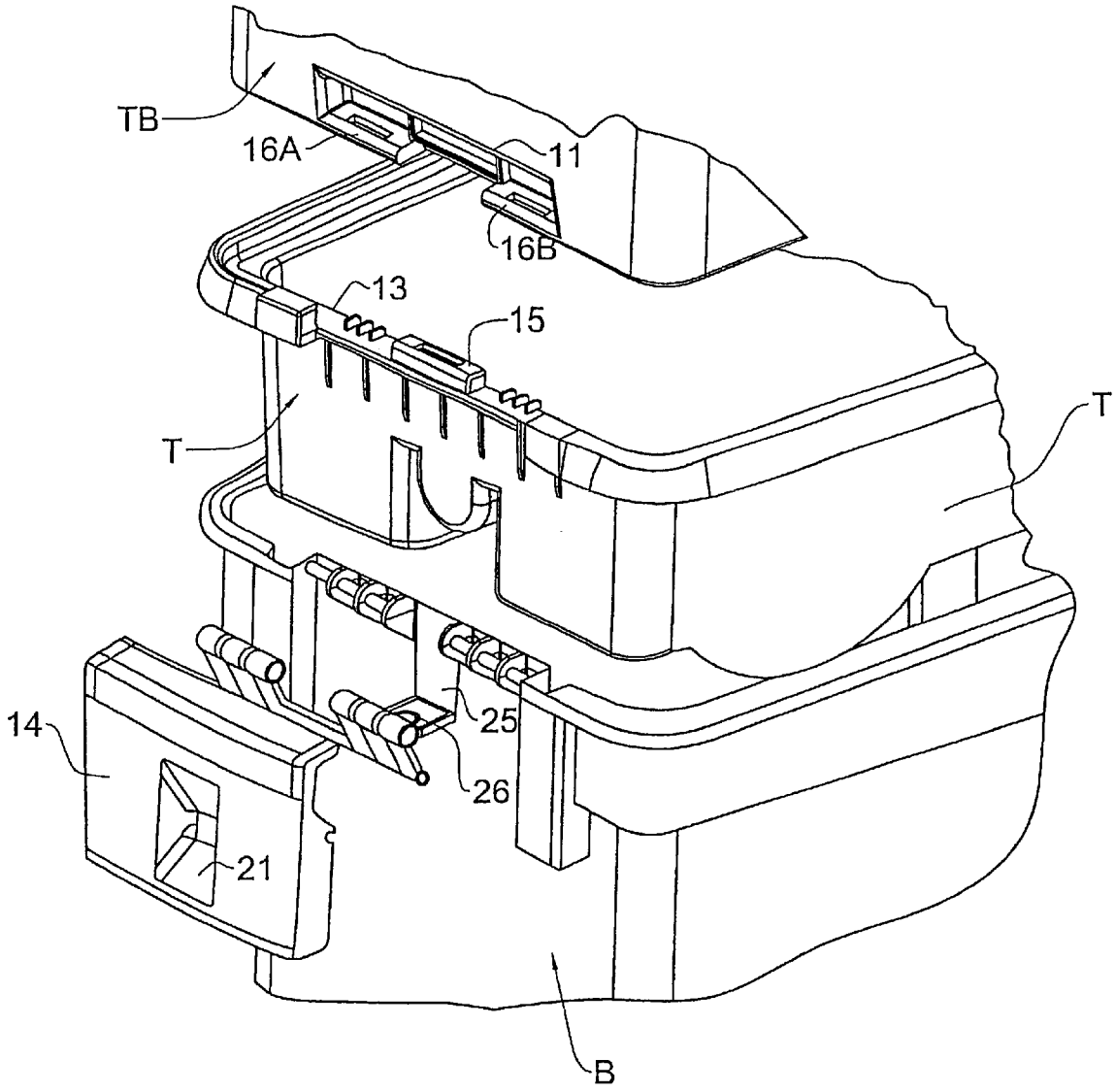
FIG. 2 illustrates the bucket, tray and tool box components of the assembly when separated from each other.

Referring now to FIGS. 1 and 2, shown therein is a portable workshop container assembly in accordance with the invention adapted to store in different compartments tools and other articles to be used to carry out various tasks at a work place, the assembly being wheeled so that it can be rolled to the work place. The major components of the assembly are a Bucket B having a large capacity, a relatively shallow Tray T nested within the upper end of the bucket, and a commodious Tool Box TB. All of these components have substantially the same cross-sectional area and are made of high-strength synthetic plastic material, such as polyethylene or polypropylene.

Attached to the front lower corners of bucket B is a pair of heavy-duty front wheels 10, the wheels preferably being rubber coated. Attached at the rear of the bucket at a midpoint on its bottom is a swivel wheel 11. This three-wheel arrangement makes it possible either to push or pull the rolling assembly. In a pull operation in which the assembly is pulled by a handle extending from tool box TB, the assembly must first be tilted so as to raise the third wheel 11 above ground, the tilted assembly then riding on its front wheels.

In a push operation, the container assembly is maintained in an erect state, as is desirable when the container is heavily loaded, and the assembly then rides on all three wheels. The advantage of a swivel rear third wheel, rather than a pair of rear wheels is that it is easier to steer the pushed rolling assembly.

Figure 5:
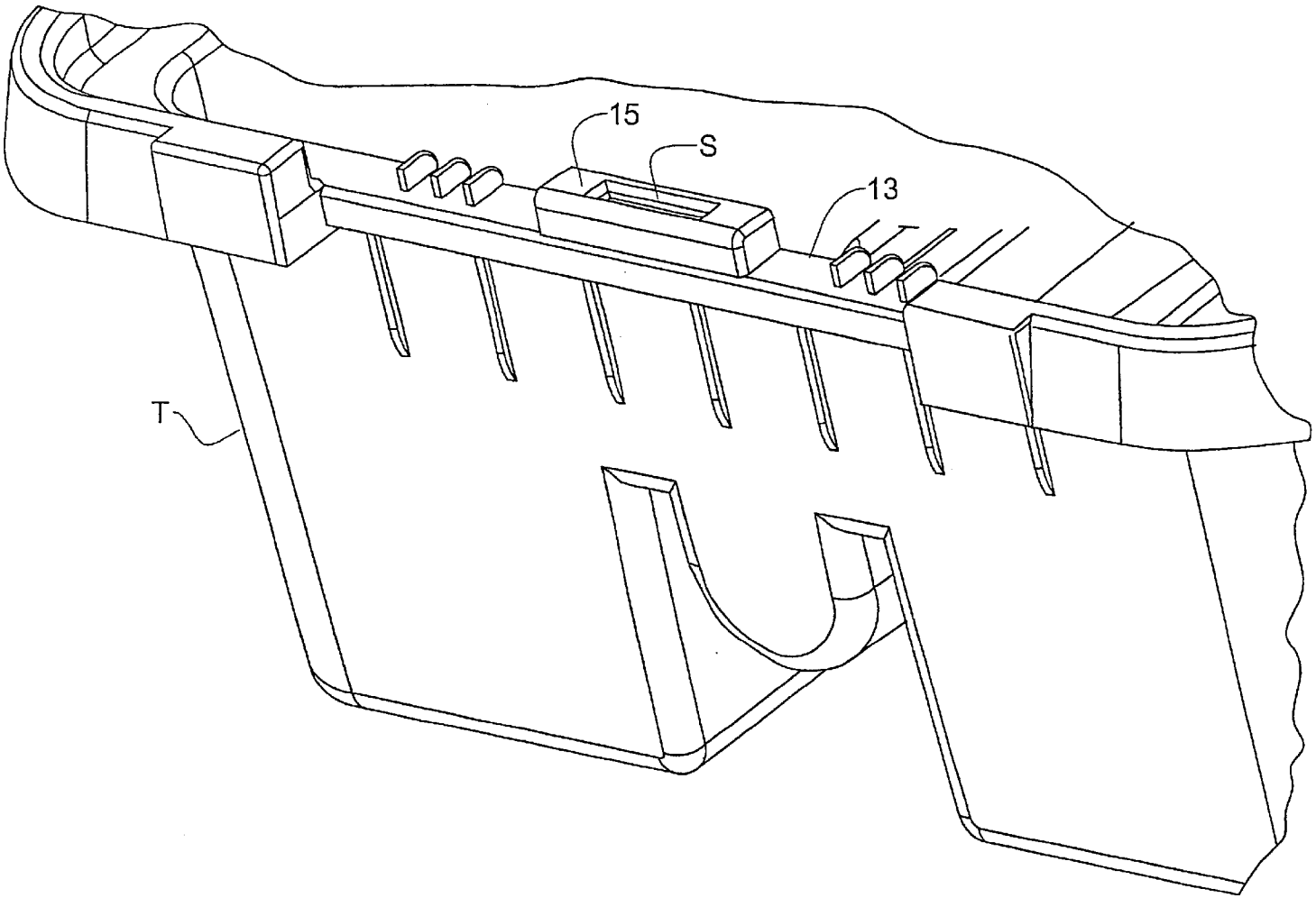
FIG. 5 shows the catch element of the latching mechanism mounted on the rim of the tray.

As best seen in FIGS. 2 and 5, the upper rectangular edge of tray T is provided with a rim 13. When tray T is nested in basket B, rim 13 then sits on the upper edge of basket B. Tool box TB which rests on rim 13 of the tray is provided with a foldable handle 14 which is shown folded up in FIG. 1 so that the assembly can be pulled by the handle.

Also provided on either side of the assembly is a selective latching mechanism, generally identified by letters M whose main function is to interlock the three major components of the assembly so that all three components (lower, middle and upper) are interlocked to form a unitary assembly.

Latching mechanism M is composed of a latch 14 (shown separately in FIG. 7) pivotally mounted by toggle members 19 to the upper end of basket B. Latch 14 is selectively engageable with a first catch element 15 mounted on the rim 13 of tray T at its center, and a second catch element formed by a spaced pair of catches 16A and 16B disposed within a recess 17 at the bottom of tool box TB.

The catch element on the rim of the tray and at the bottom of the tool box are each formed by a rectangular plastic block having a rectangular, slot S therein. Slot S is dimensioned to receive a tongue, projecting from latch 14, as will later be explained.

Figure 4:
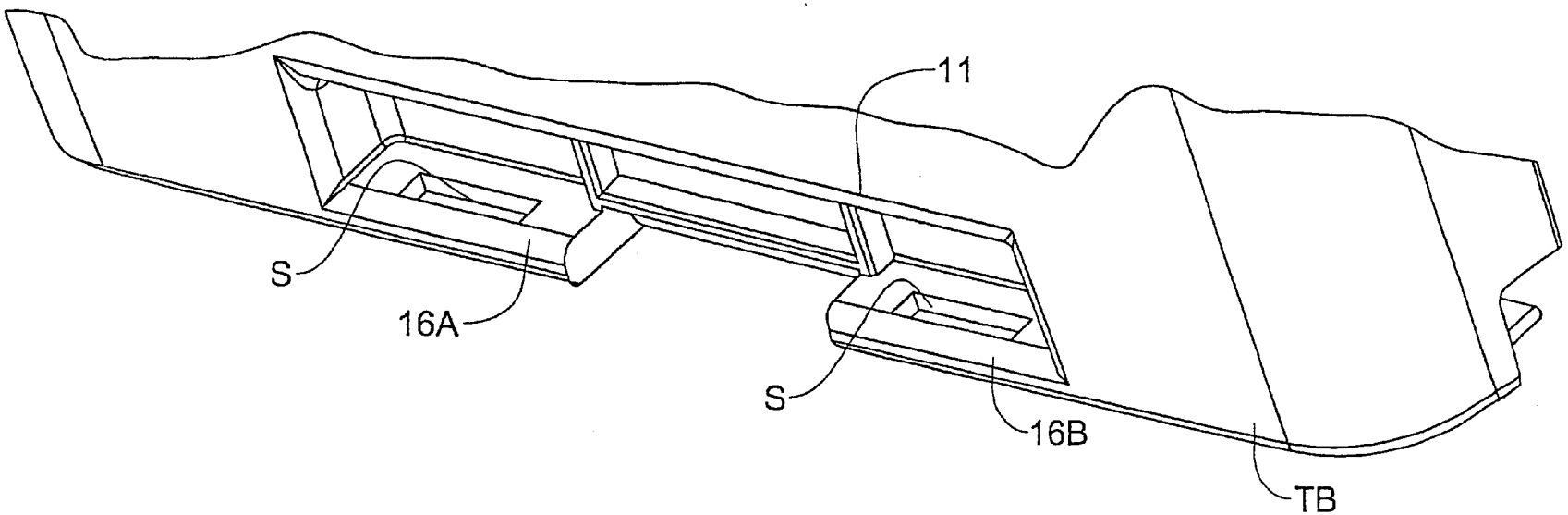
FIG. 4 shows the catch element of the latching mechanism mounted on the lower end of the tool box.
Figure 6:
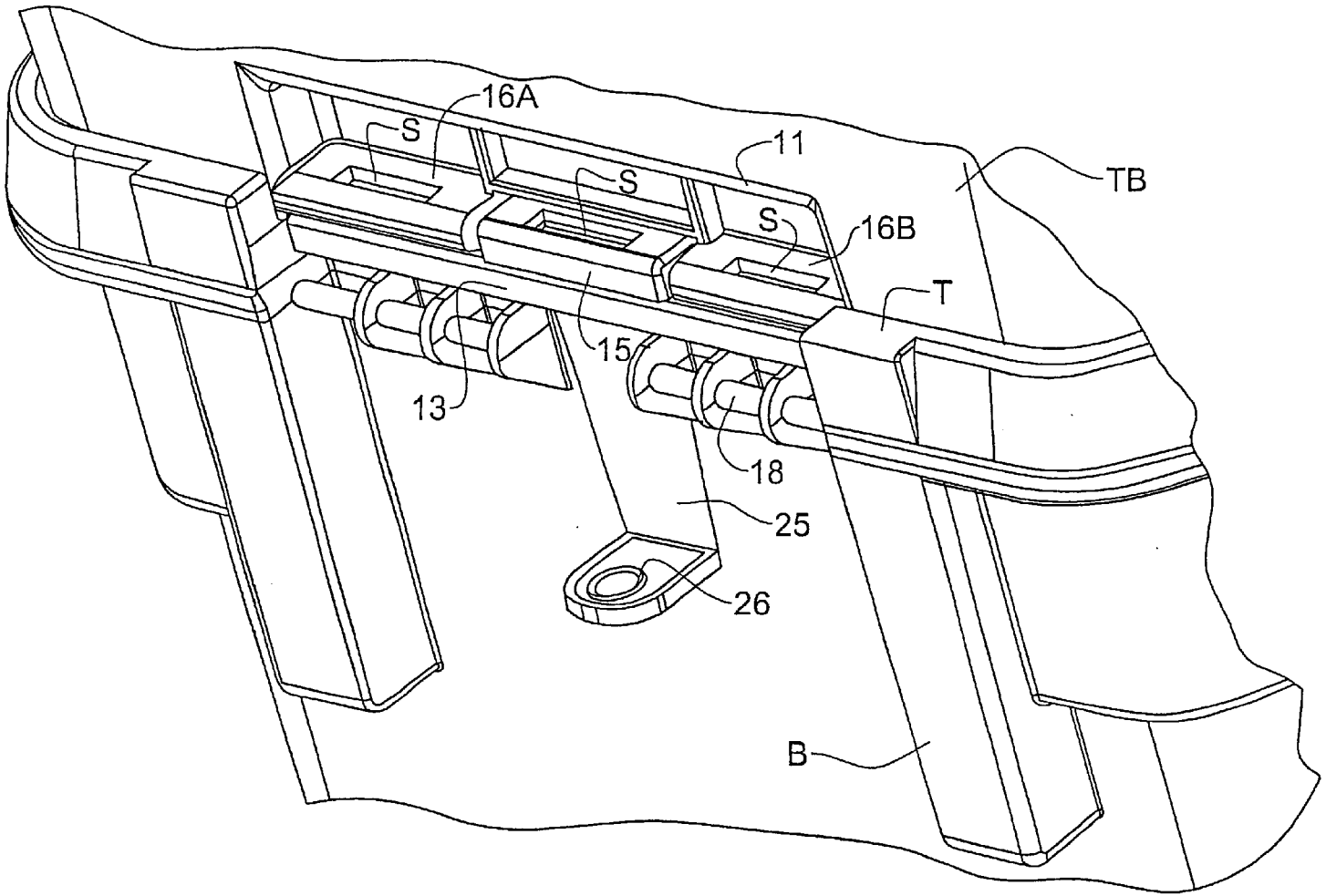
FIG. 6 shows the tool box mounted on the rim of the tray which is nested in the bucket, the catch element of the tool box and that of the tray then being adjacent each other.

FIG. 4 illustrates the pair of coplanar catches 16A and 16B which constitute the catch element on the bottom of tool box TB, and FIG. 5 illustrates the single catch element 15 on the rim 13 of tray T which nests within basket B. FIG. 6 shows tool box TB resting on the rim 13 of tray T nested within basket B. It will be seen in FIG. 6, that when the tool box rests on the tray rim, then the catch element 15 on the rim is seated in the space between the catches 16A and 16B of the tool box, and is coplanar therewith. The slots S of catch 16A, catch element 15 and catch 16 then lie along a common horizontal axis.

Figure 7:
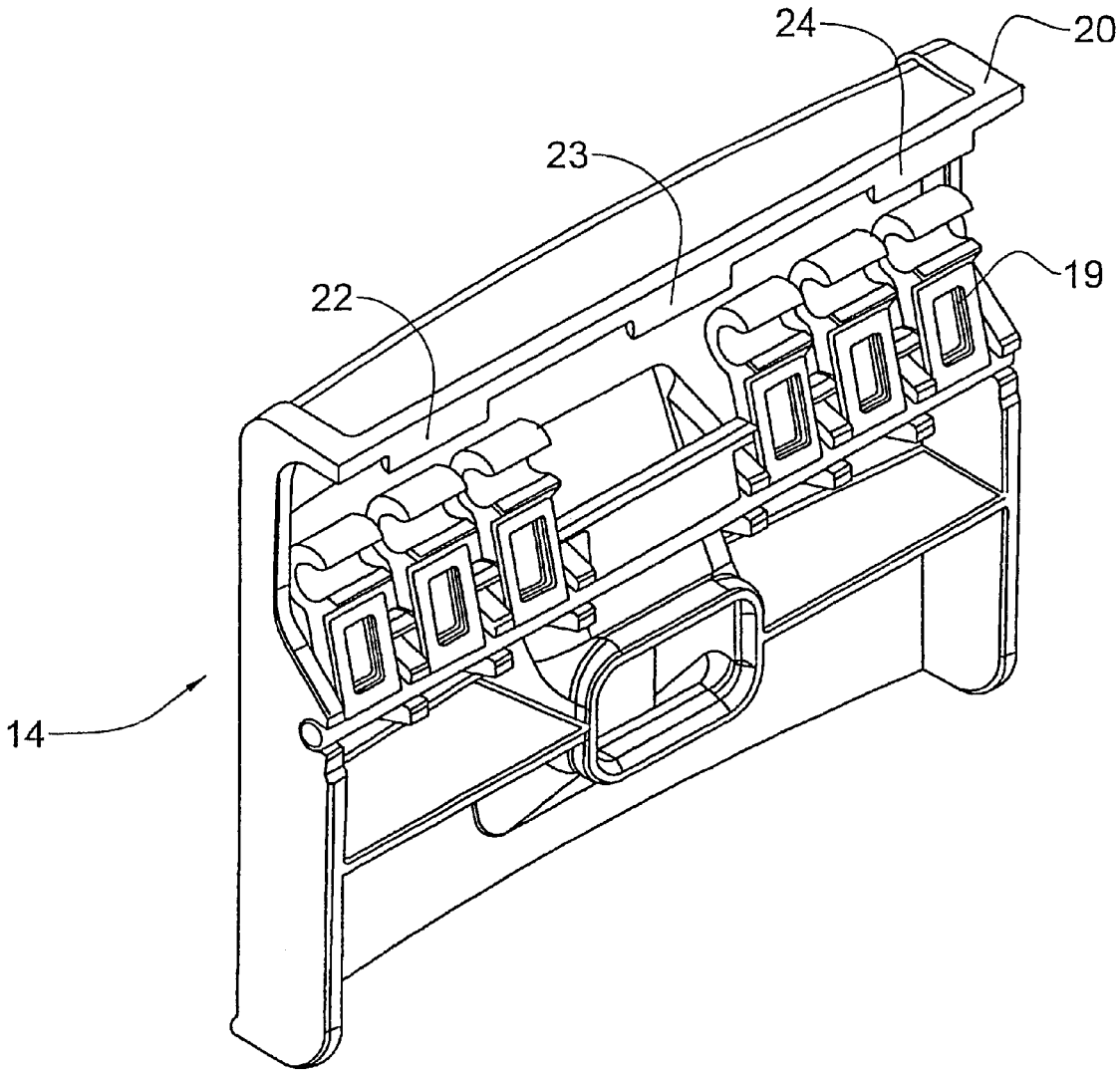
FIG. 7 is a rear view of the latch of the latching mechanism.
Figure 8:
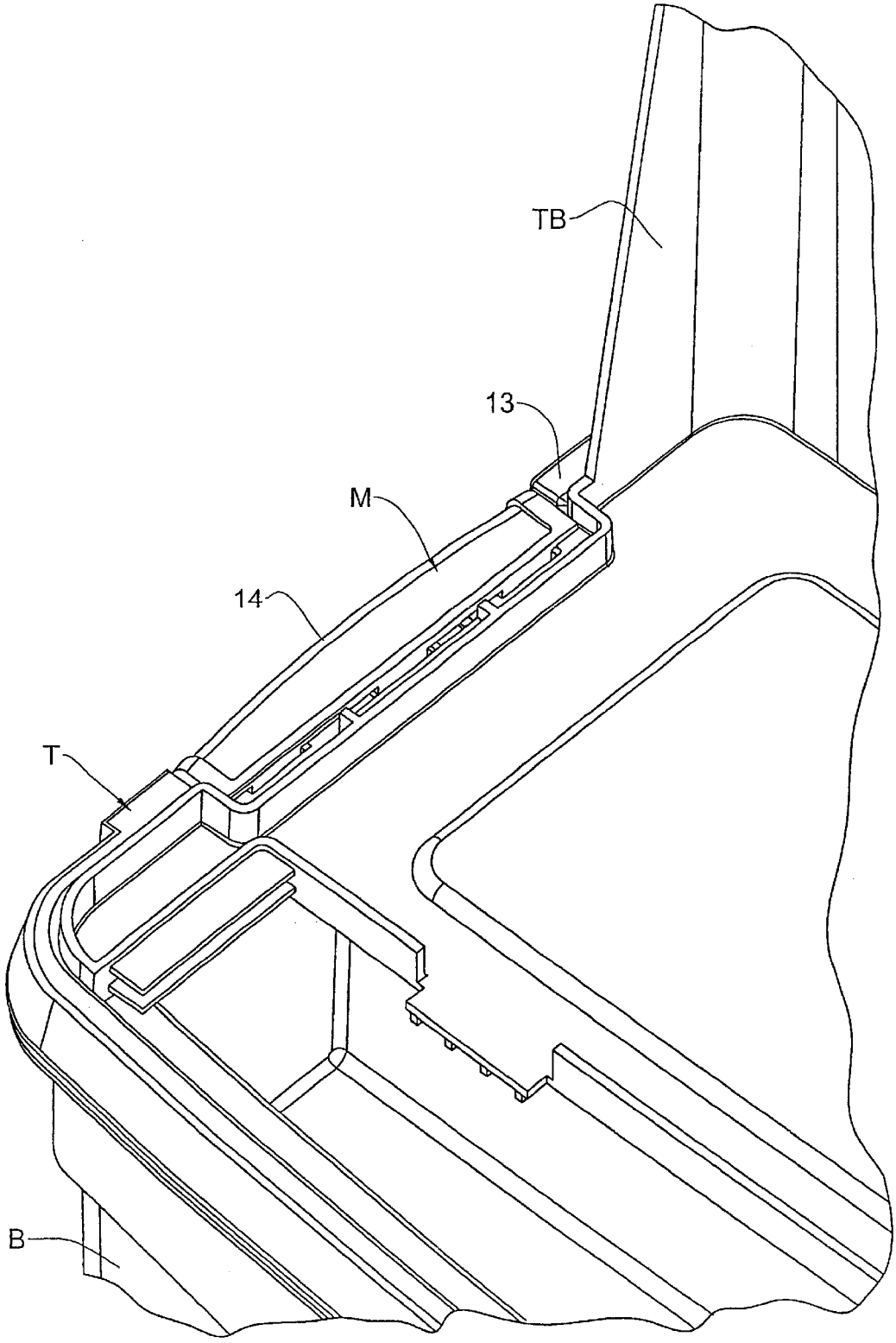
FIG. 8 is a top view showing the latch when it engages the catch elements both of the tool box and the tray.

It will be seen in FIG. 6 that supported by the upper end of bucket B below the rim 13 of the tray is a hinge pin 18 to which latch 14 shown in FIG. 7 is hinged by toggle members 19 which engage the pin.

The upper end of latch 14 is provided with an inwardly-directed ledge 20 provided with three downwardly-projecting equi-spaced tongues 22, 23 and 24. These tongues lie in registration with the slots S in the first and second catch elements only when tool box B rests on the rim of tray T. When, therefore, the toggled latch 14 is manipulated to cause its three tongues 22, 23 and 24 to enter the corresponding three slots S in the catch elements, the tool box then becomes latched to tray T which is then latched to the bucket B.

Figure 9:
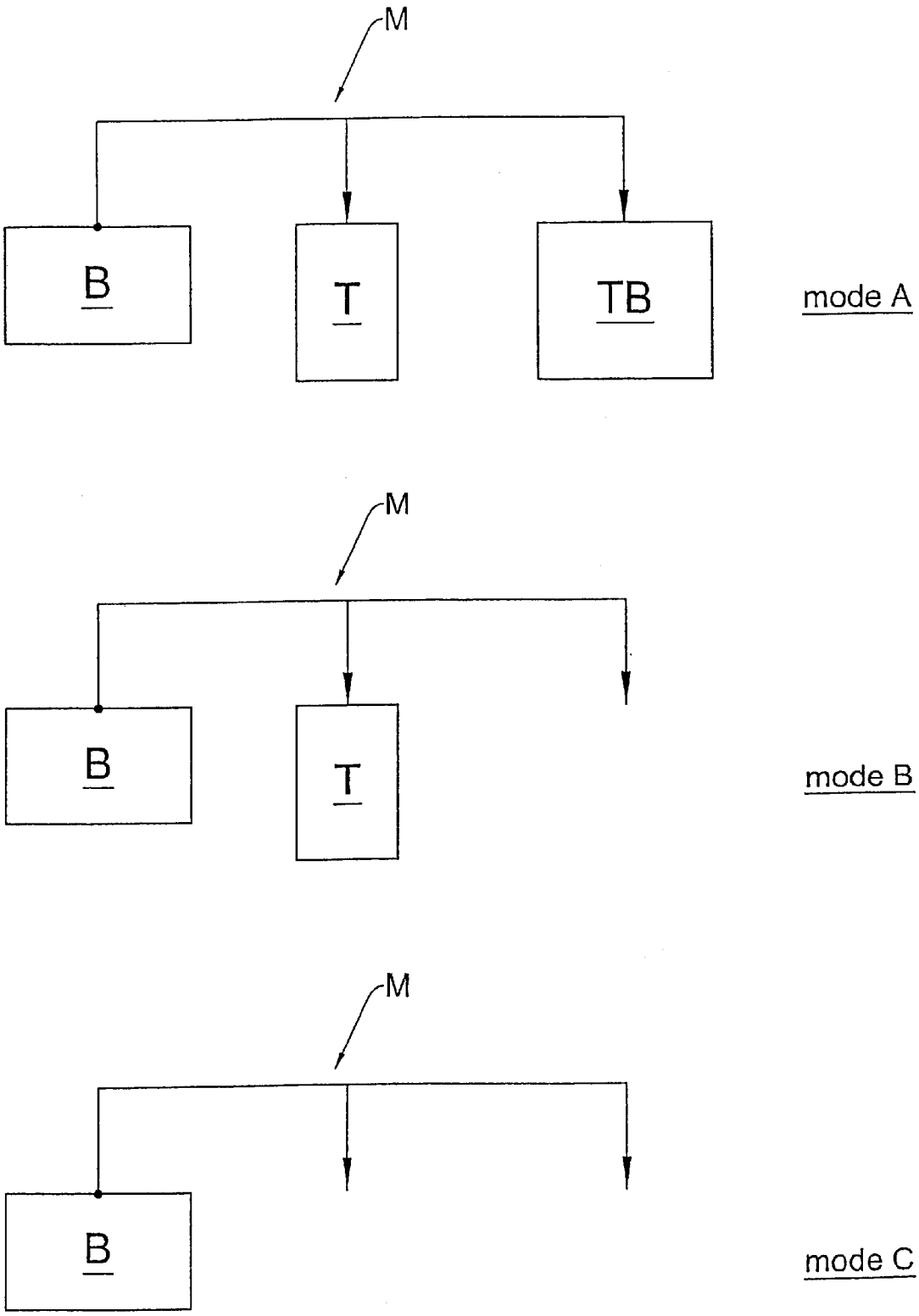
FIG. 9 is a block diagram illustrating the three modes of operation of the latching mechanism.

Latching mechanism is operable in three modes. These are illustrated schematically in FIG. 9.

Mode A

When tray T is nested in bucket B and tool box TB rests on the rim of tray T, the latching mechanism M is then operated to engage both the first and second catch elements. In this mode all the components of the assembly are interlocked to provide a unitary assembly which can be pushed or pulled to a work place.

Mode B

The latch mechanism is unlatched so that tool box TB can be removed from the assembly. The latch mechanism is then operated to engage the first catch element 15 on the rim of the tray. The tray is now locked to the bucket. Hence, a worker now has access to articles in the open tray, but does not then have access to the bucket which is closed by the tray. Access to the contents of the tool box removed from the assembly is by way of its removable lid.

Mode C

In this mode, the latching mechanism is unlatched so that the tray can be withdrawn from the bucket which is now exposed so that a worker then has access to its contents.

It is desirable when the assembly is loaded but is not in use to lock the latching mechanism so that it is not then possible to obtain access to the contents of the container. To this end, attached to the basket is a right-angle bracket 25 having a hole in its projecting lug 26 as shown in FIG. 6.

Figure 3:
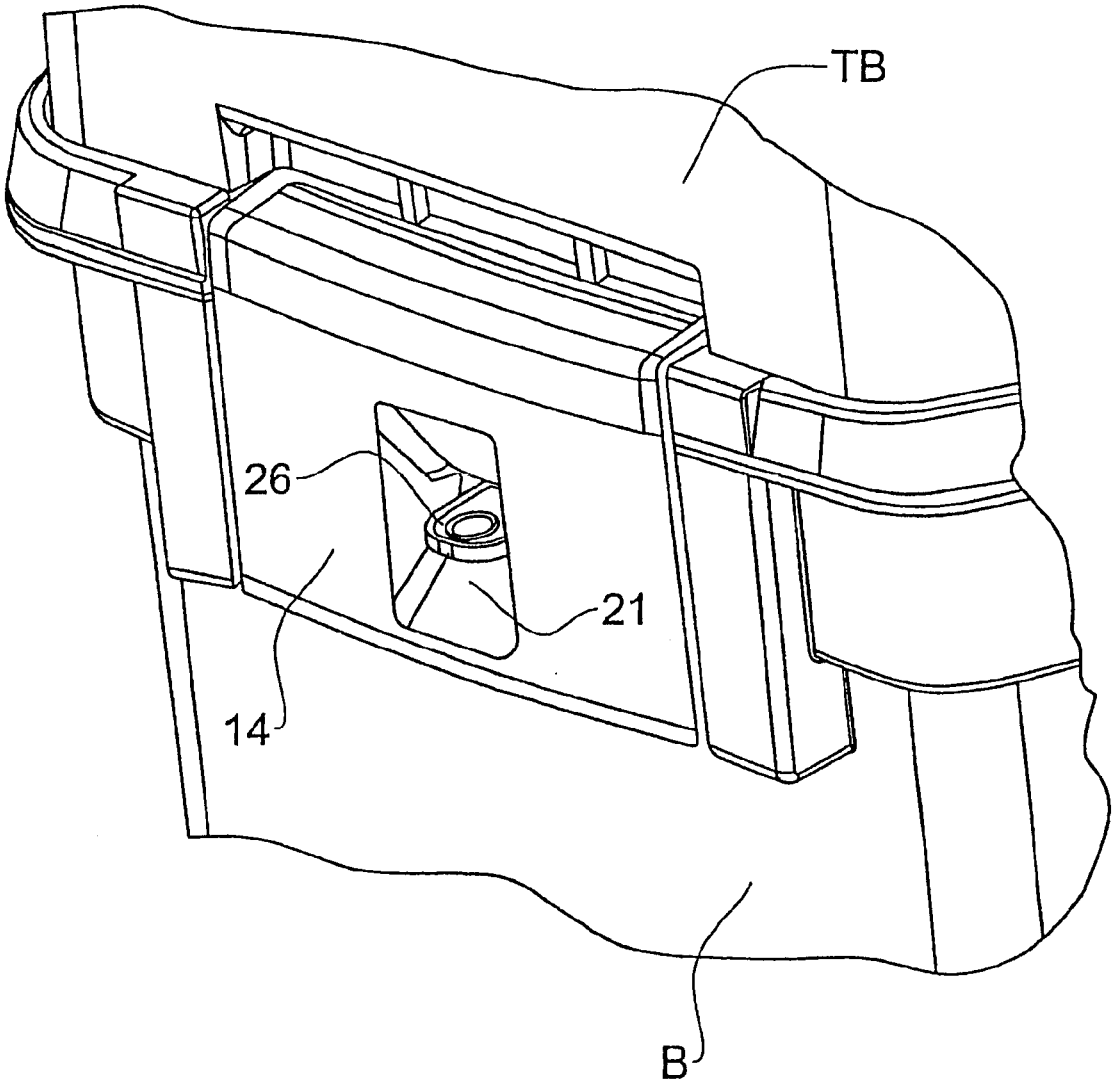
FIG. 3 shows the three components when interlocked by a latching mechanism.

Latch 14, as shown in FIG. 2, is provided with a port 27 through which lug 26 projects when the latch is closed, as shown in FIG. 3. By inserting the hasp of a key-operated lock into the hole of lug 26 one is able to lock the latching mechanism so that it cannot be manipulated. Tool box TB which has a removable lid can be locked in a conventional manner.

While there has been shown a preferred embodiment of a portable workshop container assembly, it is to be understood that many changes may be made therein without departing from the spirit of the invention. Thus, while the assembly can be scaled to function as a professional portable workshop, a smaller version can be made to convert the basement of a private home or its garage into a workshop.

What is claimed is:

1. A portable workshop container assembly comprising:

A. a bucket having an upper end;

B. a tray nested in the bucket having a rim that rests on the upper end of the bucket; said rim having a first catch mounted therein;

C. a tool box having a bottom that rests on the rim of the tray, said bottom having a second catch element mounted therein that is coplanar with the first element when the bottom rests on the rim; and D. a latch pivoted on the bucket adapted to simultaneously engages the first and second catch elements to interlock the bucket, the tray and the tool box to form a unitary assembly.

2. An assembly as set forth in claim 1, which when the tool box is withdrawn, to lock the tray to the bucket, the latch then engages only the first catch element.

3. An assembly as set forth in claim 1, in which said first catch element is formed by a block having a slot therein adapted to receive a tongue projecting from said latch.

4. An assembly as set forth in claim 3, in which said second catch element is formed by a spaced pair of catches, each formed by a block having a slot therein.

5. An assembly as set forth in claim 4, in which when the bottom of the tool box rests on the rim of the tray, the first catch element is then seated in the space between the pair of catches and is coplanar therewith to form a row of three slots.

6. An assembly as set forth in claim 5, in which said latch is provided with a set of three tongues in registration with the row of three slots.

7. An assembly as set forth in claim 3, in which the latch is pivoted on the bucket by a toggle member.

8. An assembly as set forth in claim 4, in which attached to the bucket is a pair of front wheels whereby when the assembly is tilted, it can be pulled to roll to the work place.

9. An assembly as set forth in claim 8, in which also attached to the bucket is a swiveled rear wheel whereby the assembly in an erect state can be pushed to roll to the work place.

* * * * *